US009666325B2

(12) United States Patent
Inoue et al.

(10) Patent No.: US 9,666,325 B2
(45) Date of Patent: May 30, 2017

(54) COPPER ALLOY AND METHOD OF MANUFACTURING COPPER ALLOY

(75) Inventors: Akihisa Inoue, Sendai (JP); Nobuyuki Nishiyama, Sendai (JP); Haruko Yamazaki, Sendai (JP)

(73) Assignee: TOHOKU UNIVERSITY, Sendai (JP)

( * ) Notice: Subject to any disclaimer, the term of this patent is extended or adjusted under 35 U.S.C. 154(b) by 820 days.

(21) Appl. No.: 14/008,910

(22) PCT Filed: Mar. 29, 2012

(86) PCT No.: PCT/JP2012/058358

§ 371 (c)(1),
(2), (4) Date: Jan. 3, 2014

(87) PCT Pub. No.: WO2012/133651

PCT Pub. Date: Oct. 4, 2012

(65) Prior Publication Data

US 2014/0190596 A1 Jul. 10, 2014

(30) Foreign Application Priority Data

Mar. 31, 2011 (JP) ..... 2011-077725

(51) Int. Cl.

| | |
|---|---|
| ***H01B 1/02*** | (2006.01) |
| ***C22F 1/08*** | (2006.01) |
| ***C22C 9/00*** | (2006.01) |
| *H01H 1/025* | (2006.01) |

(52) U.S. Cl.

CPC ..... *H01B 1/026* (2013.01); *C22C 9/00* (2013.01); *C22F 1/08* (2013.01); *H01H 1/025* (2013.01)

(58) Field of Classification Search

CPC .. C22C 9/00; C22F 1/08; H01B 1/026; H01H 1/025

See application file for complete search history.

(56) References Cited

U.S. PATENT DOCUMENTS

2006/0239853 A1 10/2006 Maehara et al.
2010/0170595 A1 7/2010 Kaneko et al.

(Continued)

FOREIGN PATENT DOCUMENTS

EP 1 582 602 A2 10/2005
EP 1 681 360 A1 7/2006

(Continued)

OTHER PUBLICATIONS

Translation of Oct. 20, 2015 Office Action issued in Japanese Patent Application No. 2013-507724.

(Continued)

*Primary Examiner* — Keith Walker
*Assistant Examiner* — Stephani Hill
(74) *Attorney, Agent, or Firm* — Oliff PLC

(57) ABSTRACT

Disclosed is a beryllium-free copper alloy having high strength, high electric conductivity and good bending workability and a method of manufacturing the copper alloy. Provided is a copper alloy having a composition represented by the composition formula by atom %: Cu100-a-b-c(Zr, Hf)a(Cr, Ni, Mn, Ta)b(Ti, Al)c [wherein $2.5 \leq a \leq 4.0$, $0.1 < b \leq 1.5$ and $0 \leq c \leq 0.2$; (Zr, Hf) means one or both of Zr and Hf; (Cr, Ni, Mn, Ta) means one or more of Cr, Ni, Mn and Ta; and (Ti, Al) means one or both of Ti and Al], and having Cu primary phases in which the mean secondary dendrite arm spacing is 2 μm or less and eutectic matrices in which the lamellar spacing between a metastable Cu5(Zr, Hf) compound phase and a Cu phase is 0.2 μm or less.

6 Claims, 4 Drawing Sheets

(56) References Cited

U.S. PATENT DOCUMENTS

| | | | |
|---|---|---|---|
| 2012/0145438 | A1 | 6/2012 | Muramatsu et al. |
| 2012/0148441 | A1 | 6/2012 | Muramatsu et al. |

FOREIGN PATENT DOCUMENTS

| | | | | |
|---|---|---|---|---|
| EP | 2 157 199 | A1 | | 2/2010 |
| JP | H04221031 | A | * | 8/1992 |
| JP | A-07-054079 | | | 2/1995 |
| JP | B2-2501275 | | | 5/1996 |
| JP | A-10-183274 | | | 7/1998 |
| JP | A-2005-029857 | | | 2/2005 |
| JP | A-2005-281757 | | | 10/2005 |
| JP | A-2005-281850 | | | 10/2005 |
| JP | A-2006-299287 | | | 11/2006 |
| JP | A-2008-266787 | | | 11/2008 |
| JP | A-2009-242814 | | | 10/2009 |
| JP | A-2009-242882 | | | 10/2009 |
| JP | A-2009-242895 | | | 10/2009 |
| WO | WO 2011/030898 | A1 | | 3/2011 |
| WO | WO 2011/030899 | A1 | | 3/2011 |

OTHER PUBLICATIONS

Sep. 23, 2014 Search Report issued in European Patent Application No. 12765315.2.

Jul. 3, 2012 International Search Report issued in International Application No. PCT/JP2012/058358.

* cited by examiner

COPPER ALLOY AND METHOD OF MANUFACTURING COPPER ALLOY

TECHNICAL FIELD

The present invention relates to a copper alloy which can be suitably used as an electrical contact spring components for connectors in small information equipment such as cellular phones, and also relates to a method of manufacturing the copper alloy.

BACKGROUND ART

Information equipment such as cellular phones is becoming smaller and more highly densified. The trend is likely to continue in an accelerated fashion. Conventionally, in electrical contact spring components for connectors in these instruments, particularly in components which require high strength and demanding bending workability, beryllium copper alloys such as C1720 are mainly used. However, in order to meet a narrower pitch in a future micro electrical contact spring component for connectors, beryllium copper alloys appear to be insufficient in terms of both material strength and electric conductivity. Moreover, beryllium is known as a highly toxic element, and the use of beryllium-free copper alloys is desired for the future in view of the effects on a human body and environment.

To this end, beryllium-free copper alloys having high strength and high electric conductivity have been developed. For example, known are precipitation hardening copper alloys such as Colson alloys and spinodal decomposition copper alloys such as Cu—Ni—Sn based alloys and Cu—Ti based alloys. For precipitation hardening copper alloys, attempts to develop various alloys have been extensively conducted using Cu—Zr, Cu—Cr, Cu—Ag, Cu—Fe and the like as basic compositions (for example, see Japanese Patent No. 2501275, Japanese Patent Laid-Open No. H10-183274, Japanese Patent Laid-Open No. 2005-281757, Japanese Patent Laid-Open No. 2006-299287, Japanese Patent Laid-Open No. 2009-242814). In the case of these precipitation hardening copper alloys, high strength and high electric conductivity can be achieved by adding a strength-improving alloy element to Cu to precipitate a second phase different from the Cu mother phase, and further performing high deformation to finely disperse this phase. Further, spinodal decomposition copper alloys include those in which high strength and good bending workability is achieved by using a Cu—Ni—Sn based alloy having an appropriately controlled structure (for example, see Japanese Patent Laid-Open No. 2009-242895).

However, electrically conductive copper alloys described in Japanese Patent No. 2501275, Japanese Patent Laid-Open No. H10-183274, Japanese Patent Laid-Open No. 2005-281757, Japanese Patent Laid-Open No. 2006-299287, Japanese Patent Laid-Open No. 2009-242814, Japanese Patent Laid-Open No. 2009-242895 require multiple heat treatments such as solution treatment at high temperature in which workability can be improved by primarily re-solid-dissolving alloy elements into the Cu mother phase and aging treatment in which a second phase is appropriately precipitated to obtain a desired property, and accordingly require complex processing procedures to obtain final products. Therefore, disadvantageously, a large amount of thermal energy is required. In order to solve this problem, a Cu—Zr—Ag based copper alloy has been developed which does not require multiple heat treatments, but shows high strength and high conductivity (for example, see Japanese Patent Laid-Open No. 2009-242814).

SUMMARY OF INVENTION

Technical Problem

However, the Cu—Zr—Ag based copper alloy described in Japanese Patent Laid-Open No. 2009-242814 has poorer bending workability as compared with beryllium copper for springs. In light of the situation described above, attempts have been made to develop a beryllium-free copper alloy having high strength, high electric conductivity and good bending workability. Nonetheless, a practicable alloy has not yet been found which is superior to beryllium copper alloys, including in terms of the cost of material and manufacturing.

In view of the above problem, an object of the present invention is to provide a beryllium-free copper alloy having high strength, high electric conductivity and good bending workability. Another object is to provide a method of manufacturing the above copper alloy.

Solution to Problem

After conducting extensive studies to solve the above problem, the present inventors find that a structure in which fine compound phases are uniformly dispersed in the Cu mother phase can be obtained only by performing aging heat treatment at relatively low temperature after processing without the need of solution treatment at high temperature before processing, and as a result, a copper alloy having good bending workability, high strength and high electric conductivity can be manufactured. Thus the present invention has been completed.

Specifically, the copper alloy according to the present invention is represented by the composition formula by atom %: $Cu_{100-a-b-c}(Zr, Hf)_a(Cr, Ni, Mn, Ta)_b(Ti, Al)_c$ [wherein $2.5 \le a \le 4.0$, $0.1 < b \le 1.5$ and $0 \le c \le 0.2$; (Zr, Hf) means one or both of Zr and Hf; (Cr, Ni, Mn, Ta) means one or more of Cr, Ni, Mn and Ta; and (Ti, Al) means one or both of Ti and Al], and characterized by having Cu primary phases in which the mean secondary dendrite arm spacing is 2 μm or less and eutectic matrices in which the lamellar spacing between a metastable $Cu_5(Zr, Hf)$ compound phase and a Cu phase is 0.2 μm or less.

The method of manufacturing the copper alloy according to the present invention comprises: dissolving a master alloy prepared by formulating each element to give a composition represented by the composition formula by atom %: $Cu_{100-a-b-c}(Zr, Hf)_a(Cr, Ni, Mn, Ta)_b(Ti, Al)_c$ [wherein, $2.5 \le a \le 4.0$, $0.1 < b \le 1.5$ and $0 \le c \le 0.2$; (Zr, Hf) means one or both of Zr and Hf; (Cr, Ni, Mn, Ta) means one or more of Cr, Ni, Mn and Ta; and (Ti, Al) means one or both of Ti and Al]; and then rapidly solidifying the master alloy.

The copper alloy according to the present invention can be suitably manufactured by the method of manufacturing the copper alloy according to the present invention. In the case of the copper alloy according to the present invention, since a group of one or both additive elements of Zr and Hf has negative heat of mixing with Cu, the melting point is decreased. In addition, Cu dendrites having a mean secondary dendrite arm spacing of 2 μm or less are formed as a primary phase, and the remaining melt forms a metastable $Cu_5(Zr, Hf)$ compound phase between Cu and the group of additive elements. The solid solution of the group of additive elements and the formation of the metastable compound in the eutectic matrix comprising the metastable $Cu_5(Zr, Hf)$ compound phase and the Cu phase can improve strength without significantly sacrificing the electric conductivity of Cu. Note that the mean secondary dendrite arm spacing can be determined, for example, from the cross sectional structure parallel to the direction of thermal flux at the time of casting.

For the copper alloy according to the present invention, in a case where the additive amount of a group of one or both additive elements of Zr and Hf is less than 2.5 atom %, the strength improvement effect is small since an amount of the compound produced is decreased. On the other hand, in a case where the additive amount of this additive element group is more than 4.0 atom %, the electric conductivity of the copper alloy is compromised, and in addition, plastic deformability and bending workability are deteriorated since an amount of the Cu dendrites produced as primary phases is small.

In the copper alloy according to the present invention, a group of one or more additive elements of Cr, Ni, Mn and Ta shows a strong crystal grain micronizing effect on the remaining melt except for the primary phase Cu dendrites of the Cu—(Zr, Hf) binary alloy. As a result, the eutectic matrix structure comprising the metastable $Cu_5$(Zr, Hf) compound phase and the Cu phase in which the group of the additive elements thereof is solid-dissolved will have a lamellar spacing of 0.2 μm or less. This can prevent deterioration of electric conductivity and bending workability while improving strength.

In the copper alloy according to the present invention, in a case where the additive amount of the group of one or more additive elements of Cr, Ni, Mn and Ta is 0.1 atom % or less, the lamellar spacing of the eutectic matrix structure will not be 0.2 μm or less, showing no improvement in strength. On the other hand, in a case where the additive amount of this additive element group is more than 1.5 atom %, the volume fraction of the metastable $Cu_5$(Zr, Hf) compound phase in the eutectic matrix structure increases, and in addition, this compound phase undergoes grain growth, and the lamellar spacing will not be 0.2 μm or less. This deteriorates electric conductivity and bending workability.

In the copper alloy according to the present invention, since a group of one or both additive elements of Ti and Al is slightly solid-dissolved in the Cu phase in which the primary phase Cu dendrites and the element group (Cr, Ni, Mn, Ta) in the eutectic matrix structure are solid-dissolved, the strength of the both phases can be further improved. The copper alloy according to the present invention can show both high strength and high electric conductivity even in a case where it does not contain one or both additive elements of Ti and Al. However, in a case where the additive amount of this additive element group is more than 0.2 atom %, since the compound phase is formed in between the element group (Zr, Hf) during solidification, the effects of the element group (Zr, Hf) is compromised and strength and bending workability are deteriorated.

As described above, the copper alloy according to the present invention has high strength, high electric conductivity and good bending workability. Further, the copper alloy according to the present invention is remarkably less hazardous to human and environment and much safer since it does not contain highly toxic beryllium. According to the method of manufacturing the copper alloy according to the present invention, Cu primary phases having a mean secondary dendrite arm spacing of 2 μm or less and eutectic matrices having a lamellar spacing of 0.2 μm or less between a metastable $Cu_5$(Zr, Hf) compound phase and a Cu phase can be formed by rapidly solidifying a master alloy in which each element is formulated and dissolved, thereby a copper alloy having high strength, high electric conductivity and good bending workability can be manufactured. Note that the copper alloy according to the present invention may contain O, S, Fe, As, Sb and the like as unavoidable impurities, but the total amount of these is 0.1 atom % or less.

In the copper alloy according to the present invention, the Cu primary phases and the eutectic matrices are preferably layered each other by cold working. Further, the method of manufacturing the copper alloy according to the present invention preferably comprises: performing cold working with a processing rate of between 81% and 99.5% inclusive so that the Cu primary phases having a mean secondary dendrite arm spacing of 2 μm or less and eutectic matrices having a lamellar spacing of 0.2 μm or less between the metastable $Cu_5$(Zr, Hf) compound phase and the Cu phase are layered each other after the rapid solidification as described above.

In these cases, a cold working rate of between 81% and 99.5% inclusive, preferably between 90% and 99.5% inclusive in the method of manufacturing the copper alloy according to the present invention can provide layered Cu primary phase dendrite phases having increased strength as well as good deformability, and thereby a copper alloy in which the Cu primary phases and the eutectic matrices are layered each other can be manufactured. Electric conductivity can be improved by forming a structure in which the Cu primary phases and the eutectic matrices are layered each other. In a case where the cold working rate is less than 81%, sufficient strain can not be introduced, and thus the formation of a compound phase and a micronizing effect on the structure due to re-distribution of the solid-dissolved additive element group may not be obtained, resulting in a poor strength improvement effect. On the other hand, in a case where the cold working rate is more than 99.5%, a crack may be formed during processing such as rolling, and a sound copper alloy can not be manufactured. Note that rolling is preferred as cold working, but extrusion, wire-drawing, forging and press forming may be used.

The method of manufacturing the copper alloy according to the present invention preferably comprises: performing aging heat treatment at a temperature ranging from 300 to 450° C. for 0.5 to 2 hours after the above cold working. In this case, a structure can be obtained in which fine metastable $Cu_5$(Zr, Hf) compound phases are uniformly dispersed in the Cu phase, and electric conductivity and strength can be improved. By this, a copper alloy can be manufactured having a tensile strength of 1000 MPa or more, an electric conductivity of 30% IACS or more and the ratio $R_{min}/t$ of 1 or less wherein t represents a plate thickness and $R_{min}$ represents a minimum bending radius without causing a crack when performing bending work in the direction of the plate thickness and in the direction orthogonal to the rolling direction after aging heat treatment. Thereby, a copper alloy can be manufactured having high strength, high electric conductivity and good bending workability. Note that IACS (International Annealed Copper Standard) refers to a value expressed in a relative ratio to the electric conductivity of annealed pure copper.

In a case where the temperature during aging heat treatment is less than 300° C., electrical conductivity may not be improved by aging heat treatment since the strain introduced during cold working can not be sufficiently released. Further, in a case where the temperature during aging heat treatment is more than 450° C., strength is decreased since crystal grains become coarse. In a case where the duration of aging heat treatment is less than 0.5 hour, electrical conductivity may not be improved by aging heat treatment since the strain introduced during cold working can not be sufficiently released. Further, in a case where the duration of aging heat treatment is more than 2 hours, strength is decreased since crystal grains become coarse. Note that aging heat treatment may be performed under any atmosphere. In order to prevent surface oxidation, aging heat treatment may be performed preferably under vacuum atmosphere or under an inert gas atmosphere. Further, any method may be used for heating. Any method may be used for cooling after the heating, but air cooling or water cooling is preferred in view of working efficiency.

According to the copper alloy and the method of manufacturing the copper alloy according to the present invention comprising performing cold working and aging heat treatment, strength and electric conductivity can be relatively easily controlled at a highly balanced fashion by changing the alloy composition and the cold working rate and the conditions for aging heat treatment accordingly. Further, the manufacturing and processing cost can be reduced since solution treatment which requires quenching is not necessary after heating at high temperature for long time.

Advantageous Effects of Invention

The present invention can provide a beryllium-free copper alloy having high strength, high electric conductivity and good bending workability, and also provide a method of manufacturing the copper alloy.

DESCRIPTION OF EMBODIMENTS

In the followings, embodiments of the present invention will be described based on drawings.

FIGS. 1 to 6 show a copper alloy according to an embodiment of the present invention, and the method of manufacturing the copper alloy.

The copper alloy according to an embodiment of the present invention is represented by the composition formula by atom %: $Cu_{100-a-b-c}(Zr, Hf)_a(Cr, Ni, Mn, Ta)_b(Ti, Al)_c$ [wherein, $2.5 \le a \le 4.0$, $0.1 < b \le 1.5$ and $0 \le c \le 0.2$; (Zr, Hf) means one or both of Zr and Hf; (Cr, Ni, Mn, Ta) means one or more of Cr, Ni, Mn and Ta; and (Ti, Al) means one or both of Ti and Al], and has Cu primary phases in which the mean secondary dendrite arm spacing is 2 μm or less and eutectic matrices in which the lamellar spacing between a metastable $Cu_5(Zr, Hf)$ compound phase and a Cu phase is 0.2 μm or less.

Figure 1:
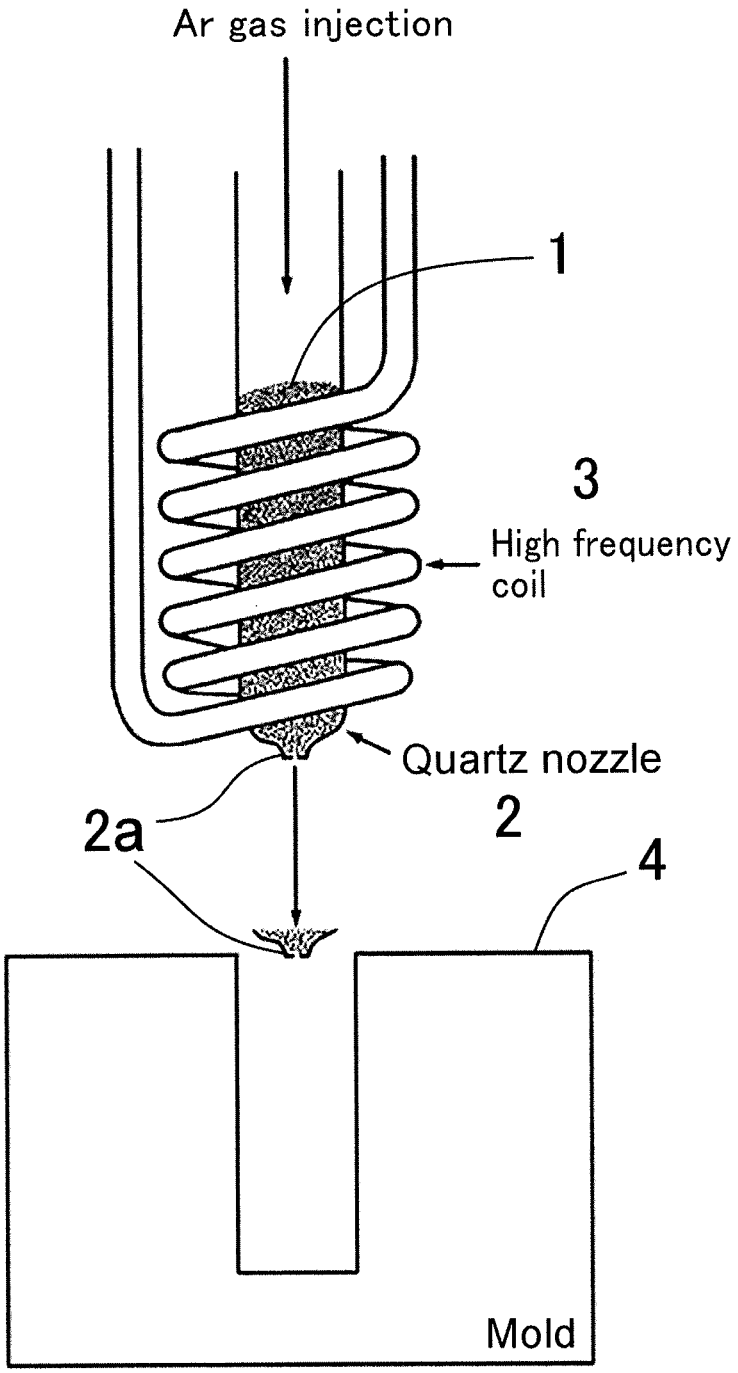
FIG. 1 is a schematic side view showing the method of manufacturing a copper alloy according to an embodiment of the present invention.

The copper alloy of an embodiment of the invention is manufactured by the method of manufacturing the copper alloy of an embodiment of the present invention as shown below. First, as shown in FIG. 1, a master alloy 1 is pre-melted in an arc melting furnace under an argon atmosphere, and loaded into a quartz nozzle 2, and then re-melted by high frequency induction heating with a high frequency coil 3. In this case, the master alloy 1 is prepared by formulating each element to give a composition represented by the composition formula by atom %: $Cu_{100-a-b-c}(Zr, Hf)_a(Cr, Ni, Mn, Ta)_b(Ti, Al)_c$ [wherein, $2.5 \le a \le 4.0$, $0.1 < b \le 1.5$ and $0 \le c \le 0.2$; (Zr, Hf) means one or both of Zr and Hf; (Cr, Ni, Mn, Ta) means one or more of Cr, Ni, Mn and Ta; and (Ti, Al) means one or both of Ti and Al]. Further, the methods of melting the master alloy 1 may not be limited only to arc melting and high frequency induction heating under an argon atmosphere, but may include resistance heating, electron beam heating and the like.

The molten metal of the re-melted master alloy 1 is ejected from an orifice 2*a* at the lower part of the quartz nozzle 2 with gas pressure and the like, and casted into a copper mold 4 placed in the lower part of the quartz nozzle 2 to allow rapid solidification. At this time, since a group of one or both additive elements of Zr and Hf has negative heat of mixing with Cu, the melting point is decreased. In addition, Cu dendrites in which the mean secondary dendrite arm spacing is 2 μm or less is formed as a primary phase, and the remaining melt forms a metastable $Cu_5(Zr, Hf)$ compound phase in between the additive element group and Cu. The solid solution of the additive element group and the formation of the metastable compound in the eutectic matrix comprising the metastable $Cu_5(Zr, Hf)$ compound phase and the Cu phase can improve strength without significantly sacrificing the electric conductivity of Cu.

Further, a group of one or more additive elements of Cr, Ni, Mn and Ta shows a strong crystal grain micronizing effect on the remaining melt except for the primary phase Cu dendrites of the Cu—(Zr, Hf) binary alloy. As a result, the eutectic matrix structure comprising the metastable $Cu_5(Zr, Hf)$ compound phase and the Cu phase in which the group of the additive elements thereof is solution-dissolved will have a lamellar spacing of 0.2 μm or less. This can prevent deterioration of electric conductivity and bending workability while improving strength.

Further, since a group of one or both additive elements of Ti and Al is slightly solid-dissolved in the Cu phase in which the primary phase Cu dendrites and the element group (Cr, Ni, Mn, Ta) in the eutectic matrix structure are solid-dissolved, the strength of the both phases can be further improved. Note that a material of the mold 4 in which rapid solidification is performed is not limited to copper, and but steel, copper alloys and the like are preferred. Further, the shape of the mold 4 is not limited to be cylindrical, and a block-like shape, a plate-like shape, a tabular shape and the like can be also devised. A copper alloy ingot can be obtained by this rapid solidification.

Next, cold working is performed on the resulting copper alloy ingot with a processing rate of between 81% and 99.5% inclusive. By this, the copper alloy is formed to have a structure in which Cu primary phases and eutectic matrices are layered each other. Note that cold working is not necessarily limited to rolling, but may be extrusion, wire-drawing, forging, press forming and the like.

Next, after the cold working, aging heat treatment is performed at a temperature ranging from 300 to 450° C. for 0.5 to 2 hours. By this, a copper alloy can be manufactured having a tensile strength of 1000 MPa or more, an electric conductivity of 30% IACS or more and the ratio $R_{min}/t$ of 1 or less wherein t represents a plate thickness and $R_{min}$ represents a minimum bending radius without causing a crack when performing bending work in the direction of the plate thickness and in the direction orthogonal to the rolling direction after aging heat treatment. Thereby, a copper alloy can be obtained having high strength, high electric conductivity and good bending workability. Note that any treatment atmospheres, heating methods and cooling methods can be selected for aging heat treatment, but a vacuum atmosphere and an inert gas atmosphere are preferred in order to prevent surface oxidation. Note that cooling after the heating is preferably performed by air cooling or water cooling in view of working efficiency.

Figure 2:
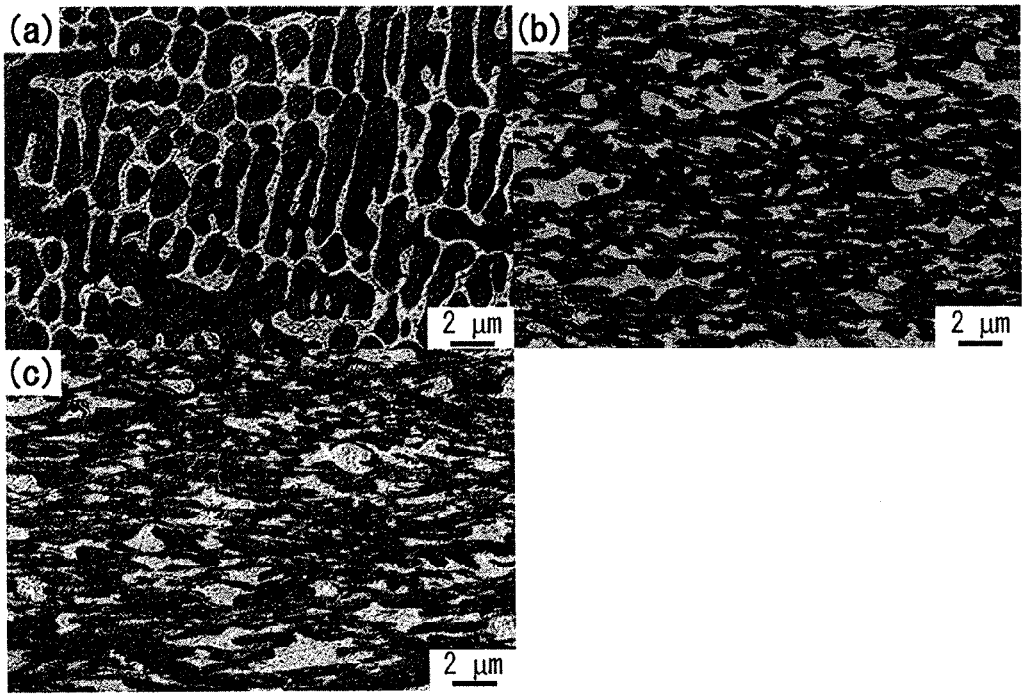
FIG. 2 shows micrographs showing (a) a cross sectional structure after rapid solidification of a copper alloy according to an embodiment of the present invention having the composition: $Cu_{96}Zr_3Ni_1$, (b) a cross sectional structure after cold working, (c) a cross sectional structure after aging heat treatment.

FIG. 2 shows a cross sectional structure of the copper alloy obtained in this way having a composition of $Cu_{96}Zr_3Ni_1$. FIG. 2 (*a*) shows a cross sectional view of the copper alloy after the rapid solidification, but before performing cold working. The black structures shown in FIG. 2 (*a*) represent Cu primary phase dendrites while the remaining gray structures represent the eutectic matrices comprising the metastable $Cu_5$(Zr, Hf) compound phase and the Cu phase in which the additive elements are dissolved to a level of supersaturation. The mean secondary dendrite arm spacing of the Cu primary phases and the lamellar spacing of the eutectic matrices are found to be about 0.8 μm and about 0.09 μm, respectively.

Further, FIG. 2 (*b*) shows a cross sectional structure when performing 92% cold working by rolling on the $Cu_{96}Zr_3Ni_1$ copper alloy shown in FIG. 2 (*a*). The thickness of the structure in the direction perpendicular to the rolling direction is 0.2 to 2 μm for the black Cu primary phase dendrite structure and the gray eutectic matrix structure. The both phases are found to form a layered structure each other as the structures are substantially extended in the rolling direction.

Further, FIG. 2 (*c*) shows a cross sectional structure after performing aging heat treatment of the $Cu_{96}Zr_3Ni_1$ copper alloy shown in FIG. 2 (*b*) at 350° C. for 1 hour. The thickness of the structure in the direction perpendicular to the rolling direction is 0.2 to 2 μm for the black Cu primary phase dendrite structure and the gray eutectic matrix structure. The extended structure by rolling is found to be maintained.

Figure 3:
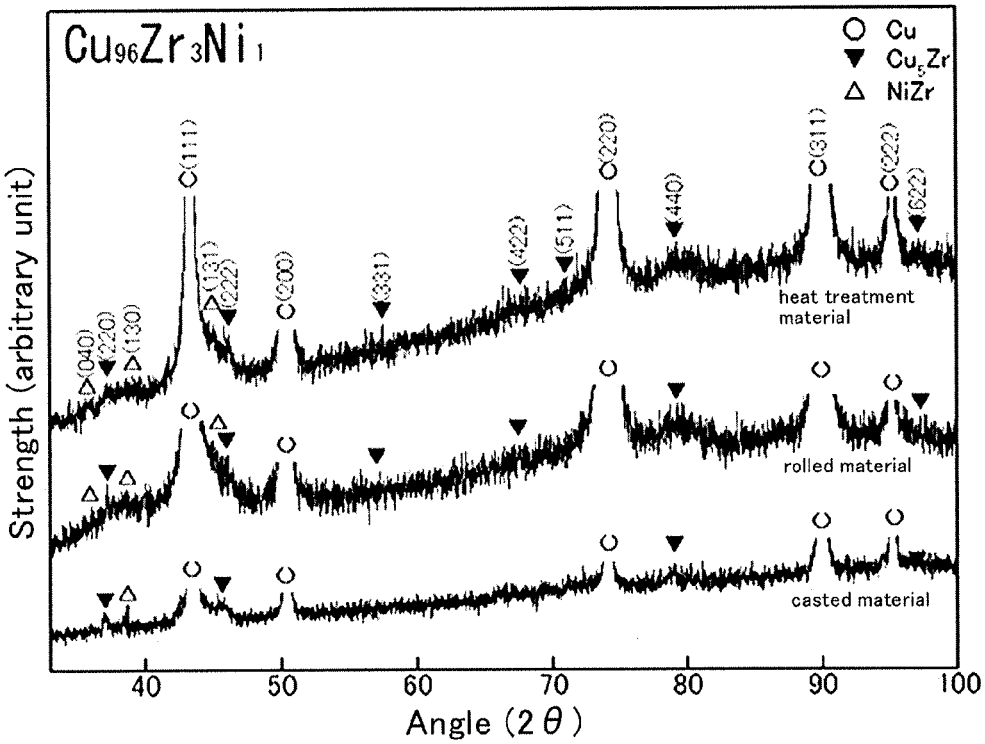
FIG. 3 shows a graph showing the X diffraction patterns of the copper alloy shown in FIG. 2 (FIG. 2 (*a*) represents "casted material," FIG. 2 (*b*) represents "rolled material" and FIG. 2 (*c*) represents "heat treated material").

FIG. 3 shows the X diffraction pattern of the $Cu_{96}Zr_3Ni_1$ copper alloy shown in FIG. 2. The "casted material," "rolled material" and "heat treatment material" in FIG. 3 correspond to the copper alloy in FIG. 2 (*a*), FIG. 2 (*b*) and FIG. 2 (*c*), respectively. As shown in FIG. 3, a Cu phase in the face centered cubic structure and a metastable $Cu_5$(Zr, Hf) compound phase are identified in the X diffraction pattern of the "casted material." Further, a Cu phase in the face centered cubic structure and a metastable $Cu_5$(Zr, Hf) compound phase are identified in the X diffraction pattern of the "rolled material" as in the "casted material." The same phases are identified in the X diffraction pattern of the "heat treatment material" as in the diffraction pattern of the "rolled material." No new phase is found to be formed other than the Cu phase and the metastable $Cu_5$(Zr, Hf) compound phase by aging heat treatment.

Figure 4:
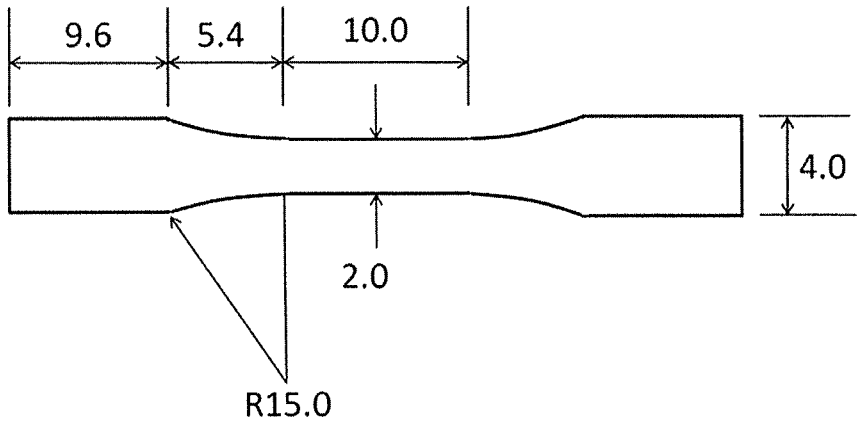
FIG. 4 is a top view showing a shape of a test piece for characterization of the copper alloy shown in FIG. 2 (*c*).
Figure 5:
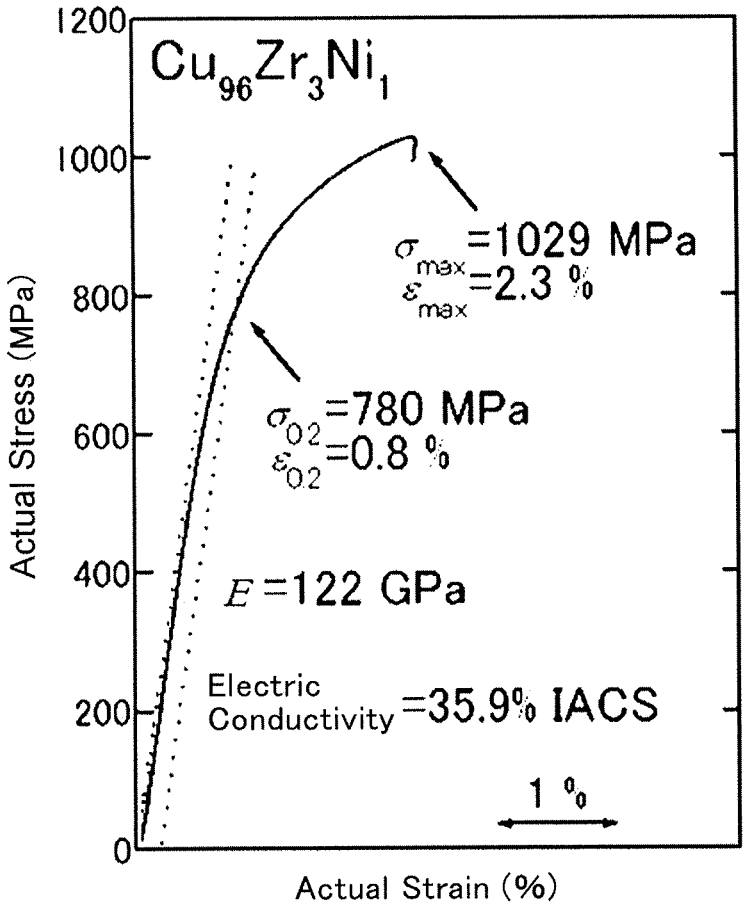
FIG. 5 shows a graph showing an actual stress-actual strain curve and electric conductivity under tensile stress for the test piece of the copper alloy shown in FIG. 4.

The copper alloy in FIG. 2 (*c*) was punched out to give a dimension shown in FIG. 4 (the unit in FIG. 4 is mm, and the thickness is 0.12 mm), and then this plate-like test piece was characterized. As an example, the actual stress-actual stain curve and the electric conductivity of this test piece under tensile stress are shown in FIG. 5. The rate of strain was $5.0\times10^{-4}$ per second, and electric conductivity was evaluated by the four probe method after removing surface oxidation scale of the test piece. As shown in FIG. 5, the 0.2% proof stress was 780 MPa, the Young's modulus was 122 GPa, the tensile strength was 1030 MPa, the fracture strain were 2.3% and the electric conductivity was 35.9% IACS.

Figure 6:
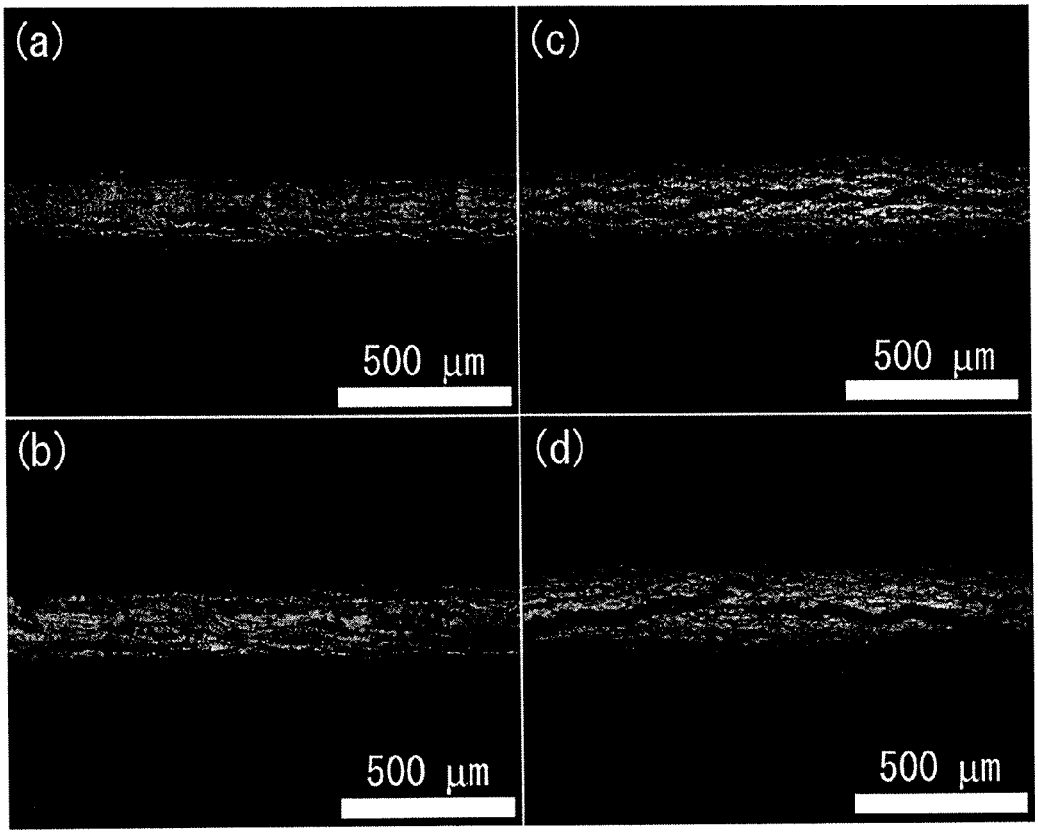
FIG. 6 shows micrographs showing the surface conditions of the test piece of the copper alloy shown in FIG. 4 after bending work (a) in the direction parallel to the rolling direction, (b) in the direction orthogonal to the rolling direction; and the surface conditions of a beryllium copper plate after bending work (c) in the direction parallel to the rolling direction, (b) in the direction perpendicular to the rolling direction.

Further, FIGS. 6 (*a*) and (*b*) show micrographs showing the surface conditions (the side of tensile stress) after performing bending work on the test piece with a W-type jig having a tip radius of 0.05 mm (pursuant to JIS H 3130). FIG. 6 (*a*) shows the surface conditions after bended in the direction parallel to the rolling direction while FIG. 6 (*b*) shows the surface conditions after bended in the direction orthogonal to the rolling direction. Note that for comparison, FIGS. 6 (*c*) and (*d*) show micrographs showing the surface conditions (the side of tensile stress) after performing bending work on a commercially available beryllium copper plate with a thickness of 0.12 mm using the same W-type jig. FIG. 6 (*c*) shows the surface conditions after bended in the direction parallel to the rolling direction while FIG. 6 (*d*) shows the surface conditions after bended in the direction orthogonal to the rolling direction. Note that in this case, the ratio $R_{min}/t$ of the plate thickness t (=0.12 mm) and the minimum bending radius $R_{min}$ (=0.05 mm) at the time of bending work is 0.42.

While a crack was observed on the surface of the beryllium copper plate by bending work as shown in FIGS. 6 (*c*) and (*d*) while no crack was observed on the surface of the copper alloy according to the embodiment of the invention by bending work as shown in FIGS. 6 (*a*) and (*b*), demonstrating good bending workability.

As described above, the copper alloy according to an embodiment of the invention manufactured by the method of manufacturing the copper alloy according to an embodiment of the invention has high strength, high electric conductivity and good bending workability. Further, the copper alloy according to an embodiment of the present invention is remarkably less hazardous to human and environment and much safer since it does not contain highly toxic beryllium.

Example 1

By using the method of manufacturing the copper alloy of an embodiment of the invention, 18 different copper alloys according to an embodiment of the invention (samples 1 to 18) are manufactured. Table 1 summarizes the composition, the secondary dendrite arm spacing (SDA spacing), the lamellar spacing, the processing rate (rolling reduction rate) in cold working by rolling, the temperature and duration of aging heat treatment, the 0.2% proof strength as determined by tensile testing, the Young's modulus, the tensile strength and fracture strain, the electric conductivity and the bending workability thereof in the direction parallel and orthogonal to the rolling direction. In this case, the electric conductivity was measured by the four probe method after removing surface oxidation scale of the copper alloys. Further, the bending workability was evaluated as GOOD if no clear crack was observed on the surface when each sample having a plate thickness of 0.12 mm was bent with a W-type jig having a tip radius of 0.05 mm ($R_{min}/t=0.42$), and BAD if a crack was observed.

even when the ratio $R_{min}/t$ of the plate thickness t and the minimum bending radius $R_{min}$ was 0.42, no crack was observed. This demonstrated that they also had good bending workability.

TABLE 1

| Sample No. | Alloy Composition (atom %) | Casted Material: SDA* Spacing (μm) | Casted Material: Lamellar Spacing (μm) | Rolled Material: Rolling Reduction Rate (%) | Aging Heat Treatment: Temperature (° C.) | Aging Heat Treatment: Duration (h) | Mechanical Properties: 0.2% Proof Stress (MPa) | Mechanical Properties: Young's Modulus (GPa) | Mechanical Properties: Tensile Strength (MPa) | Mechanical Properties: Fracture Strain (%) | Electric Conductivity (% IACS) | Bending Workability: Parallel Direction | Bending Workability: Orthogonal Direction |
|---|---|---|---|---|---|---|---|---|---|---|---|---|---|
| 1 | $Cu_{96}Zr_3Ni_1$ | 0.8 | 0.09 | 92 | 350 | 1 | 780 | 122 | 1030 | 2.3 | 35.9 | GOOD | GOOD |
| 2 | $Cu_{96.5}Zr_3Cr_{0.5}$ | 1.5 | 0.14 | 88 | 375 | 1 | 775 | 128 | 1040 | 2.1 | 38.5 | GOOD | GOOD |
| 3 | $Cu_{96}Zr_3Mn_1$ | 0.8 | 0.09 | 90 | 350 | 1 | 810 | 130 | 1025 | 1.9 | 39.4 | GOOD | GOOD |
| 4 | $Cu_{96.7}Zr_3Ta_{0.3}$ | 0.9 | 0.07 | 91 | 350 | 1 | 760 | 126 | 1030 | 2.2 | 39.8 | GOOD | GOOD |
| 5 | $Cu_{95}Zr_4Ni_1$ | 0.7 | 0.06 | 95 | 350 | 1 | 890 | 133 | 1080 | 2.2 | 40.3 | GOOD | GOOD |
| 6 | $Cu_{96.5}Zr_{2.5}Ni_1$ | 0.9 | 0.09 | 91 | 350 | 1 | 765 | 119 | 1010 | 2.4 | 43.1 | GOOD | GOOD |
| 7 | $Cu_{95.8}Zr_3Ni_1Al_{0.2}$ | 1.2 | 0.08 | 92 | 350 | 1 | 790 | 121 | 1045 | 2.0 | 41.2 | GOOD | GOOD |
| 8 | $Cu_{95.9}Zr_3Ni_1Ti_{0.1}$ | 0.9 | 0.08 | 92 | 350 | 1 | 790 | 121 | 1045 | 2.0 | 39.9 | GOOD | GOOD |
| 9 | $Cu_{96}Zr_{2.5}Hf_{0.5}Ni_1$ | 1.2 | 0.09 | 90 | 350 | 1 | 785 | 119 | 1035 | 1.9 | 40.2 | GOOD | GOOD |
| 10 | $Cu_{95}Zr_2Hf_2Ni_1$ | 0.7 | 0.09 | 91 | 420 | 1.5 | 790 | 131 | 1065 | 2.2 | 41.2 | GOOD | GOOD |
| 11 | $Cu_{96.5}Zr_{2.5}Hf_{0.5}Ta_{0.5}$ | 1.0 | 0.09 | 93 | 350 | 1 | 760 | 118 | 1005 | 2.3 | 35.9 | GOOD | GOOD |
| 12 | $Cu_{95.5}Zr_2Hf_2Cr_{0.5}$ | 0.8 | 0.07 | 92 | 450 | 1.5 | 820 | 136 | 1095 | 1.9 | 35.8 | GOOD | GOOD |
| 13 | $Cu_{96}Zr_3Ni_{0.5}Cr_{0.5}$ | 1.1 | 0.13 | 90 | 350 | 1 | 790 | 127 | 1045 | 2.2 | 36.1 | GOOD | GOOD |
| 14 | $Cu_{96}Zr_3Mn_{0.5}Ta_{0.5}$ | 0.8 | 0.08 | 92 | 350 | 1 | 770 | 130 | 1040 | 2.1 | 37.3 | GOOD | GOOD |
| 15 | $Cu_{95.9}Zr_{2.5}Hf_{0.5}Ni_1Al_{0.1}$ | 1.4 | 0.11 | 90 | 375 | 1.5 | 805 | 127 | 1065 | 2.0 | 42.1 | GOOD | GOOD |
| 16 | $Cu_{95.8}Zr_{2.5}Hf_{0.5}Ni_1Ti_{0.2}$ | 0.82 | 0.12 | 90 | 375 | 1.5 | 805 | 125 | 1065 | 2.0 | 37.5 | GOOD | GOOD |
| 17 | $Cu_{96}Zr_3Ni_{0.5}Cr_{0.3}Mn_{0.2}$ | 0.8 | 0.08 | 91 | 450 | 0.5 | 800 | 129 | 1055 | 2.1 | 32.1 | GOOD | GOOD |
| 18 | $Cu_{96}Zr_3Ni_{0.5}Mn_{0.3}Ta_{0.2}$ | 1.3 | 0.07 | 93 | 430 | 1.0 | 795 | 131 | 1065 | 2.2 | 31.4 | GOOD | GOOD |

SDA*: Secondary Dendrite Arm Spacing

As shown in Table 1, each of the copper alloys according to an embodiment of the invention was found to have a tensile strength $\sigma_f$ of 1000 MPa or more, an electric conductivity δ of 30% IACS or more. This demonstrated that they all had good strength and electric conductivity. Further, As Comparative Examples, the compositions and the like are summarized for the copper alloys (comparison samples 1 to 22) manufactured by the similar manufacturing method using different conditions shown in Table 2.

TABLE 2

| Sample No. | Alloy Composition (atom %) | Casted Material: SDA* Spacing (μm) | Casted Material: Lamellar Spacing (μm) | Rolled Material: Rolling Reduction Rate (%) | Aging Heat Treatment: Temperature (° C.) | Aging Heat Treatment: Duration (h) | Mechanical Properties: 0.2% Proof Stress (MPa) | Mechanical Properties: Young's Modulus (GPa) | Mechanical Properties: Tensile Strength (MPa) | Mechanical Properties: Fracture Strain (%) | Electric Conductivity (% IACS) | Bending Workability: Parallel Direction | Bending Workability: Orthogonal Direction |
|---|---|---|---|---|---|---|---|---|---|---|---|---|---|
| 1 | $Cu_{97}Zr_2Ni_1$ | 2.2 | 0.31 | 95 | 400 | 1 | 625 | 127 | 875 | 1.8 | 39.6 | GOOD | BAD |
| 2 | $Cu_{95}Zr_{4.5}Cr_{0.5}$ | 1.9 | 0.08 | 93 | 400 | 1 | 765 | 130 | 985 | 1.5 | 40.7 | BAD | BAD |
| 3 | $Cu_{96.9}Zr_3Ni_{0.1}$ | 2.1 | 0.25 | 92 | 350 | 1 | 515 | 118 | 680 | 1.8 | 42.5 | GOOD | GOOD |
| 4 | $Cu_{95}Zr_3Ni_2$ | 2.0 | 0.08 | 91 | 400 | 1.5 | 770 | 124 | 910 | 1.8 | 28.4 | GOOD | BAD |
| 5 | $Cu_{96.9}Zr_3Cr_{0.1}$ | 2.2 | 0.28 | 92 | 350 | 1 | 645 | 122 | 780 | 1.7 | 36.3 | GOOD | GOOD |
| 6 | $Cu_{95}Zr_3Cr_2$ | 2.1 | 0.09 | 91 | 400 | 1.5 | 580 | 135 | 620 | 1.6 | 25.8 | BAD | BAD |
| 7 | $Cu_{96.9}Zr_3Mn_{0.1}$ | 2.4 | 0.25 | 85 | 350 | 1 | 735 | 124 | 835 | 1.8 | 37.2 | GOOD | GOOD |
| 8 | $Cu_{95}Zr_3Mn_2$ | 1.8 | 0.07 | 88 | 400 | 1.5 | 640 | 130 | 730 | 1.7 | 22.1 | BAD | BAD |
| 9 | $Cu_{96.9}Zr_3Ta_{0.1}$ | 2.3 | 0.24 | 90 | 350 | 1 | 775 | 121 | 820 | 1.8 | 35.6 | GOOD | GOOD |
| 10 | $Cu_{95}nZr_3Ta_2$ | 1.9 | 0.09 | 94 | 400 | 1.5 | 725 | 133 | 910 | 1.9 | 24.9 | BAD | BAD |
| 11 | $Cu_{97}Zr_1Hf_1Ni_1$ | 2.2 | 0.29 | 93 | 350 | 1 | 740 | 120 | 925 | 1.9 | 38.2 | GOOD | GOOD |
| 12 | $Cu_{94}Zr_{2.5}Hf_{2.5}Ni_1$ | 1.4 | 0.07 | 90 | 400 | 1.5 | 505 | 129 | 510 | 1.3 | 39.3 | BAD | BAD |
| 13 | $Cu_{95.5}Zr_3Ni_1Al_{0.5}$ | 1.6 | 0.07 | 91 | 350 | 1 | 695 | 127 | 845 | 1.7 | 33.4 | BAD | BAD |
| 14 | $Cu_{95.5}Zr_3Ni_1Ti_{0.5}$ | 1.9 | 0.08 | 91 | 400 | 1.5 | 720 | 130 | 820 | 1.8 | 35.1 | BAD | BAD |
| 15 | $Cu_{96}Zr_3Ni_1$ | 3.7 | 0.42 | 98 | 350 | 1 | 490 | 99 | 620 | 2.2 | 26.8 | BAD | BAD |
| 16 | $Cu_{96}Zr_3Ni_1$ | 0.8 | 0.09 | No rolling | 350 | 1 | 695 | 106 | 845 | 1.9 | 27.7 | * | * |
| 17 | $Cu_{96}Zr_3Ni_1$ | 0.8 | 0.09 | 80 | 350 | 1 | 725 | 112 | 880 | 1.9 | 29.6 | GOOD | BAD |
| 18 | $Cu_{96}Zr_3Ni_1$ | 0.8 | 0.09 | 99.8 | 350 | 1 | Not measurable due to a crack at rolling | | | | | * | * |
| 19 | $Cu_{96}Zr_3Ni_1$ | 0.8 | 0.09 | 92 | 280 | 2.0 | Not measurable due to a crack at aging heat treatment | | | | | * | * |
| 20 | $Cu_{96}Zr_3Ni_1$ | 0.8 | 0.09 | 92 | 475 | 1 | 385 | 130 | 385 | 0.3 | 42.2 | BAD | BAD |
| 21 | $Cu_{96}Zr_3Ni_1$ | 0.8 | 0.09 | 92 | 350 | 0.3 | 590 | 118 | 770 | 1.5 | 29.9 | BAD | BAD |
| 22 | $Cu_{96}Zr_3Ni_1$ | 0.8 | 0.09 | 92 | 350 | 2.5 | Not measurable due to a crack at aging heat treatment | | | | | * | * |

SDA*: Secondary Dendrite Arm Spacing

* The bending test could not be performed due to a crack

As shown in Table 2, for the comparison samples 1 and 11, the additive amount of a group of one or both additive elements of Zr and Hf is less than 2.5 atom %, and tensile strength is poor. Further, for the comparison samples 2 and 12, the additive amount of a group of one or both additive elements of Zr and Hf is more than 4.0 atom %, and bending workability is poor. For the comparison samples 3, 5, 7 and 9, the additive amount of a group of one or more additive elements of Cr, Ni, Mn and Ta was 0.1 atom % or less, and lamellar spacing is large, and tensile strength is poor. For the comparison samples 4, 6, 8 and 10, the additive amount of a group of one or more additive elements of Cr, Ni, Mn and Ta is more than 1.5 atom %, and electric conductivity and bending workability are poor. For the comparison samples 13 and 14, the additive amounts of a group of one or both additive elements of Ti and Al is more than 0.2 atom %, and tensile strength and bending workability are poor.

The comparison samples 15 to 22 have the same composition as Example 1 in Table 1, but the comparison sample 15 is not subjected to the rapid solidification of the master alloy, and has large secondary dendrite arm spacing and lamellar spacing as well as poor tensile strength, poor electric conductivity and poor bending workability. The comparison sample 16 is not subjected to cold working (no rolling) has poor tensile strength and poor bending workability. For the comparison sample 17, the cold working rate is less than 81%, and tensile strength is poor. For the comparison sample 18, the cold working rate is more than 99.5%, and a crack occurs during cold working, and a sound copper alloy can not be manufactured.

For the comparison sample 19, the temperature at aging heat treatment is less than 300° C. and not aged, and a crack occurs during aging heat treatment, and a sound copper alloy can not be manufactured. For the comparison sample 20, the temperature at aging heat treatment is more than 450° C. and overaged, and tensile strength is poor. For the comparison sample 21, the duration of aging heat treatment is less than 0.5 hour and not aged, and electric conductivity is poor. For the comparison sample 22, the duration of aging heat treatment is more than 2 hours and overaged, a crack occurs during aging heat treatment, and a sound copper alloy can not be manufactured.

As described above, the comparison samples 1 to 22 can not satisfy at least one of the following conditions and thus can not have all of these: the tensile strength $\sigma_f$ is 1000 MPa or more; the electric conductivity δ is 30% IACS or more; the bending workability when $R_{min}/t$ is 1 or less wherein $R_{min}/t$ is a ratio of the plate thickness t and the minimum bending radius without causing a crack.

INDUSTRIAL APPLICABILITY

The copper alloy according to the present invention has strength, electric conductivity and bending workability sufficient for use as electrical contact spring components for connectors in small information equipment such as cellular phones, and thus useful.

DESCRIPTION OF REFERENCE NUMERALS

1 master alloy
2 quartz nozzle
2*a* orifice
3 high frequency coil
4 mold

The invention claimed is:

1. A copper alloy having a composition represented by the composition formula by atom %: $Cu_{100-a-b-c}(Zr, Hf)_a(Cr, Ni, Mn, Ta)_b(Ti, Al)_c$ [wherein, $2.5 \le a \le 4.0$, $0.1 < b \le 1.5$ and $0 \le c \le 0.2$; (Zr, Hf) means one or both of Zr and Hf; (Cr, Ni, Mn, Ta) means one or more of Cr, Ni, Mn and Ta; and (Ti, Al) means one or both of Ti and Al], and having Cu primary phases in which the mean secondary dendrite arm spacing is 2 μm or less and eutectic matrices in which the lamellar spacing between a metastable $Cu_5(Zr, Hf)$ compound phase and a Cu phase is 0.2 μm or less.

2. The copper alloy according to claim 1, wherein the Cu primary phases and the eutectic matrices are layered by cold working.

3. The copper alloy according to claim 2, wherein the cold working is rolling, and by performing aging heat treatment after the cold working, tensile strength is 1000 MPa or more, and electric conductivity is 30% IACS or more, and the ratio $R_{min}/t$ is 1 or less wherein t represents a plate thickness and $R_{min}$, represent a minimum bending radius without causing a crack when performing bending work in the direction of the plate thickness and in the direction orthogonal to the rolling direction after aging heat treatment.

4. The method of manufacturing the copper alloy recited in claim 1, the method comprising: dissolving a master alloy prepared by formulating each element to give a composition represented by the composition formula by atom %: $Cu_{100-a-b-c}(Zr, Hf)_a(Cr, Ni, Mn, Ta)_b(Ti, Al)_c$ [wherein $2.5 \le a \le 4.0$, $0.1 < b \le 1.5$ and $0 \le c \le 0.2$; (Zr, Hf) means one or both of Zr and Hf; (Cr, Ni, Mn, Ta) means one or more of Cr, Ni, Mn and Ta; and (Ti, Al) means one or both of Ti and Al]; and then rapidly solidifying the master alloy.

5. The method of manufacturing a copper alloy according to claim 4, comprising: performing cold working with a processing rate of between 81% and 99.5% inclusive to form a structure in which the Cu primary phases having a mean secondary dendrite arm spacing of 2 μm or less and the eutectic matrices having a lamellar spacing of 0.2 μm or less between the metastable $Cu_5(Zr,Hf)$ compound phase and the Cu phase are layered after the rapid solidification.

6. The method of manufacturing a copper alloy according to claim 5, comprising: performing aging heat treatment at a temperature ranging from 300 to 450° C. for 0.5 to 2 hours after performing the cold working.

* * * * *